US005459979A

United States Patent [19]

Tommasi

[11] Patent Number: 5,459,979

[45] Date of Patent: Oct. 24, 1995

[54] METHOD AND APPARATUS FOR CONTINUOUSLY FEEDING A DRUM MACHINE WITH COMPRESSIBLE ARTICLES, ESPECIALLY FOLDED CELLULOSE NAPKINS, FOR THE WRAPPING THEREOF IN A THIN PLASTIC ENVELOPE

[75] Inventor: Renzo Tommasi, Massa e Cozzile, Italy

[73] Assignee: Rent S.r.l., Pistoia, Italy

[21] Appl. No.: 246,970

[22] Filed: May 20, 1994

[51] Int. Cl.[6] ..... B65B 1/24

[52] U.S. Cl. ..... 53/439; 53/466; 53/530; 53/234; 100/26

[58] Field of Search ..... 53/225, 234, 439, 53/466, 993, 529, 530; 198/571 X, 572; 100/151, 41

[56] References Cited

U.S. PATENT DOCUMENTS

| | | | |
|---|---|---|---|
| 3,948,115 | 4/1976 | Seragnoli | 53/234 |
| 4,244,382 | 1/1981 | Thiele | 198/572 |
| 4,367,618 | 1/1983 | Focke | 53/234 |
| 4,845,924 | 7/1989 | Focke et al. | 53/439 |
| 4,858,416 | 8/1989 | Monaghan | 53/439 |
| 5,123,226 | 6/1992 | Near | 53/234 |

*Primary Examiner*—John Sipos
*Assistant Examiner*—Gene L. Kim
*Attorney, Agent, or Firm*—McGlew and Tuttle

[57] ABSTRACT

Apparatus for continuously feeding a drum machine with compressible articles for the wrapping thereof, comprising structure for progressively and continuously compressing the packs 1 to be wrapped which are fed by a belt conveyer 10, and at the same time transferring them towards the revolver 2 of a wrapping machine by means of a pair of superimposed belt conveyers 4 converging towards the revolver 2 of a wrapping machine by means of a pair of superimposed belt conveyers 4 converging towards the revolver 2 and each being operated by a relevant driving roller 40 parallel to the axis 21 of rotation of the revolver 2. The packs 1 being interposed individually and in succession between the belt conveyers 4. A device is provided for cyclically varying the feeding speed of the belt conveyers 4, and another device is provided for driving each of the belt conveyers 4 into an alternative rotation of predetermined angular amplitude about an axis 41 parallel to the axis 21 of rotation of the revolver 2.

15 Claims, 4 Drawing Sheets

Fig. 5A
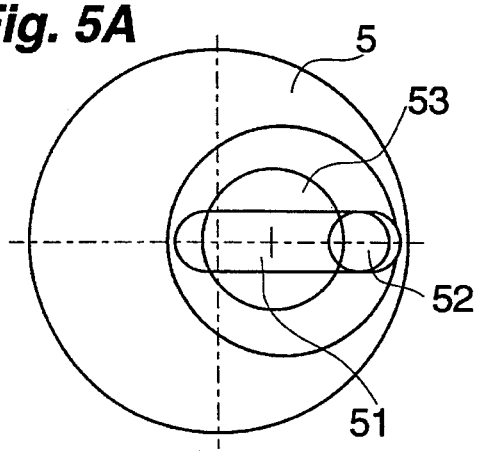
Fig. 5B
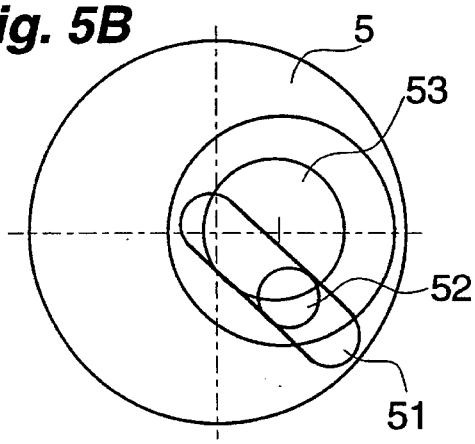
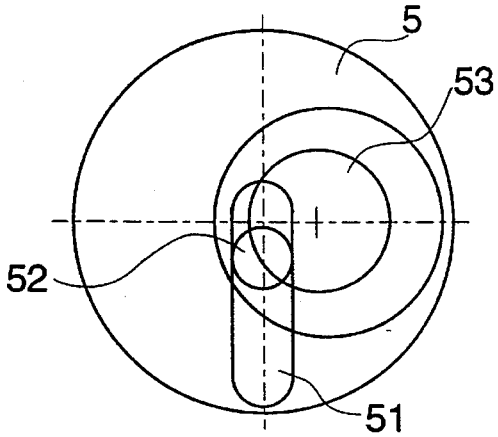
Fig. 5C
Fig. 5D
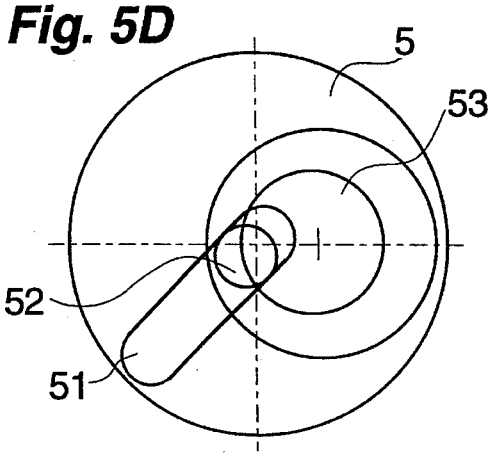
Fig. 5E
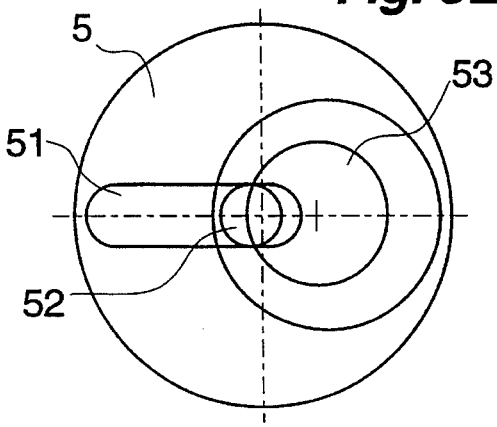

METHOD AND APPARATUS FOR CONTINUOUSLY FEEDING A DRUM MACHINE WITH COMPRESSIBLE ARTICLES, ESPECIALLY FOLDED CELLULOSE NAPKINS, FOR THE WRAPPING THEREOF IN A THIN PLASTIC ENVELOPE

FIELD OF THE INVENTION

The object of the present invention is a method and an apparatus for continuously feeding a drum machine with compressible articles such as folded paper sheets, napkins and the like, for the wrapping thereof in a thin plastic envelope.

BACKGROUND OF THE INVENTION

It is known that the drum machines for wrapping packs of paper napkins comprise an apparatus called "revolver" which consists of a drum rotating about a horizontal axis and provided with a plurality of radical chambers, hereinafter referred to as "revolver pockets", within which the packs of napkins to be wrapped are individually inserted in rapid succession, each of which packs being fed by a driving chain and suitably compressed prior to the introduction thereof into a corresponding revolver pocket. The insertion taking place with the simultaneous interposition of a film of suitable plastic material which is provided for wrapping the napkins, that is, to make up the envelope, after having been properly folded around the sides of the pack and closed by welding and/or glueing. Owing to the high rotary speed of the revolver, it is necessary to feed and compress the napkins at a rate sufficiently high to allow for successively engaging all the revolver pockets, to ensure a convenient productive capacity of the plant. This implies a synchronization, with minimum tolerance margins, of the steps for feeding, squeezing and, then, inserting the napkins into the revolver pockets, mainly as a function of the revolver peripheral speed and of the variation of the momentum to be imparted to each pack prior to the insertion thereof into the revolver pockets. All this calls for the adoption of suitable criteria in the management of the plant, in relation to both the choice of the most suitable operating speeds and the maintenance and adjustment of the individual devices, to allow the complete operative integration and maximum reliability thereof. However, as it is well known, the level and rate of activities for the maintenance and adjustment of the components weigh heavily on the economic efficiency of the plant and, accordingly, on the cost of fabrication of the finished, that is, packaged product. Thus, also in this field of industrial techniques there is a strong demand for adopting simpler constructional criteria to improve the reliability of the production systems and reduce the relevant running costs thereof and, thereby, the cost of fabrication of the packaged product.

Also known, from patent DE 3701273 A, is an apparatus for wrapping packs of paper napkins within envelopes of plastic material, which comprises:

- clamp means for compressing the napkins to be packaged which are fed by a driving chain;
- means for disposing a predetermined quantity of a film of suitable plastic material in correspondence of each revolver pocket;
- a movable arm driven into a reciprocating motion in radial direction with respect to the revolver, to insert each group of compressed napkins into a corresponding pocket and thus carrying out a first wrapping of the film around the napkins;
- means for carrying out the welding of the edges of the plastic film wrapped around the napkins, on the front and rear sides thereof, so as to close the envelope;
- means for removing the thus wrapped napkins out of the revolver.

However, this known apparatus provides for stopping each group of napkins before operating the squeezing and the subsequent insertion thereof into the revolver pockets, and for bringing the compressive means back to the respective initial operating condition before starting the wrapping of a new group of napkins. That is, bringing the compressive means back behind the next group of napkins to be wrapped, so that the feeding thereof to the revolver results discontinuous. Moreover, the functional construction of known apparatus does not allow an increase in the output of the plant, that is, in the napkins-feeding rate, beyond a given value corresponding to the operating speed of the compressive means. In addition to this, there is the fact that the constructional complexity of this known apparatus brings about an intense servicing activity which weighs on the production cost of the packaged product.

Also known form document DE 2322878 is a machine for packaging compressible products such as folded paper napkins and the like, within an envelope of a plastic, able-to-be-wrapped material. The machine comprises a pair of belt conveyers converging towards an articles-compressing device which is made up of a pair of parallel horizontal superimposed belts for moving the napkins delivered from the feeding belts, and also made of a vertical operating cylinder, in a fixed position, provided with a flat head and a corresponding stationary abutment surface, to compress the thus fed napkins. However, this known apparatus also provides for a discontinuous feeding of napkins, owing to the stoppage of the belts of the compressive device, which is necessary to allow for the intervention of the compressive cylinder. Accordingly, the output capacity of the plant cannot be raised beyond a value corresponding to the operating speed of the cylinder.

SUMMARY AND OBJECTS OF THE INVENTION

The main object of the present invention is to overcome the above said drawbacks and to provide a method and an apparatus for continuously feeding a drum-type wrapping machine with compressible articles at the maximum allowable speed.

This result has been achieved, according to the invention, by adopting an operating method which comprises, in succession, the following steps:

- progressively compressing, without solution of continuity, the packs to be wrapped, which are fed by a corresponding belt conveyer, and at the same time transferring them towards the revolver of a drum-type wrapping machine at a speed cyclically varying between a minimum value corresponding to the unloading speed of the machine making the packs, and a maximum value at which they are inserted into the revolver pockets;
- inserting individually and in continuous succession each of the thus compressed packs into a corresponding pocket of the revolver.

And for implementing the above method, an apparatus is used comprising:

means for progressively compressing, without solution of continuity, the packs to be wrapped which are fed by a belt conveyer and, at the same time, transferring them towards the revolver of a wrapping machine, by means of a pair of superimposed belt conveyers converging towards the revolver and operated by two corresponding driving rollers, the packs being interposed between said belt conveyers individually and in continuous succession;

a speed variator for cyclically varying the feeding speed of said converging belt conveyers, which variator is connected, on one side, to the shaft of a driving member and, on the other, to the shafts of said driving rollers;

means for driving said compressive belts into an alternative rotation of predetermined angular amplitude about the axes of the respective driving rollers.

The advantages drawn from the present invention lie essentially in the fact that it is possible to feed a drum machine with packs of compressible articles for the wrapping thereof, especially folded paper napkins, in a continuous way, that is, without stopping the packs during the steps for the compression thereof and then for the insertion thereof into the revolver pocket, thereby achieving the maximum output capacity of the machine and, at the same time, the maximum unloading speed of the packs-forming machine, while raising the economic efficiency of the plant and reducing the production cost of the packaged product; that a device according to the invention is cost-effective, of simple construction, is reliable and requires a greatly reduced maintenance, which enables to further lowering the running cost of the plant.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein:

FIG. 5A shows the front view of the variator of FIG. 4, in a condition in which the output shaft runs at maximum speed;

FIG. 5B shows the front view of the variator of FIG. 4, in a condition in which the output shaft undertakes a first deceleration;

FIG. 5C shows the front view of the variator of FIG. 4 in which the output shaft runs at an intermediate speed;

FIG. 5D shows the front view of the variator of FIG. 4 in a condition in which the output shaft undertakes a further deceleration;

FIG. 5E shows the front view of the variator of FIG. *4*, in a condition in which the output shaft runs at minimum speed;

DETAILED DESCRIPTION OF THE PREFERRED EMBODIMENT

Figure 1A:
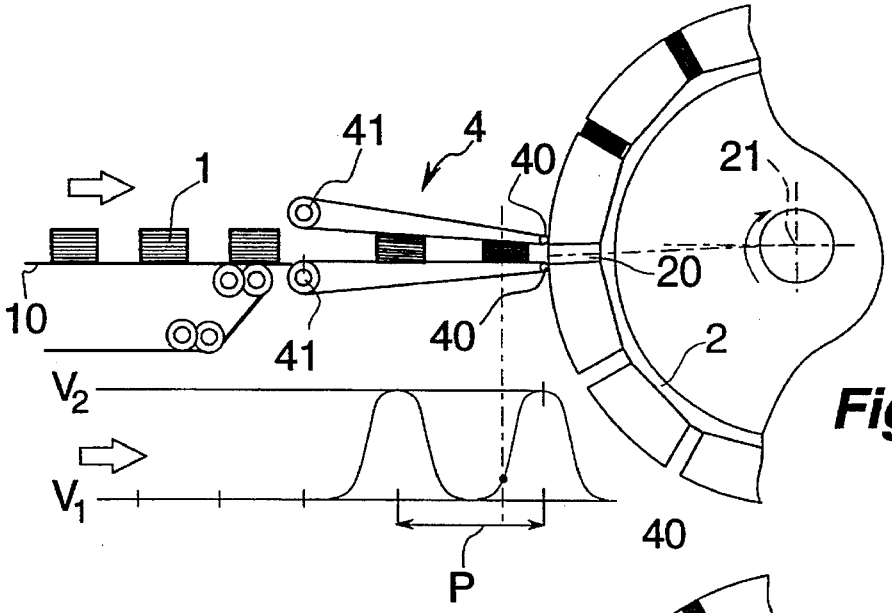
FIG. 1A shows schematically an apparatus according to the invention, in its condition of initially compressing the packs to be wrapped.
Figure 1B:
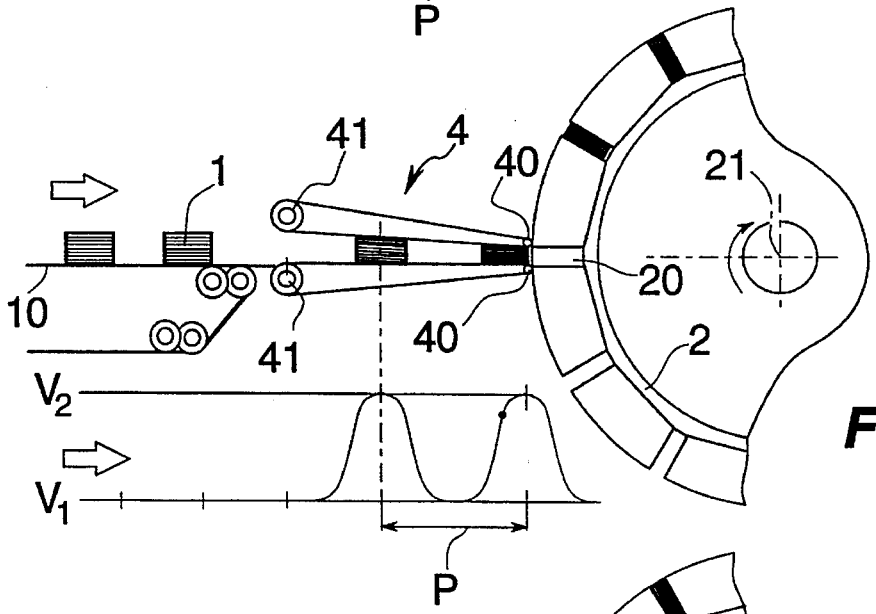
FIG. 1B shows the apparatus of FIG. 1A in its condition of initially inserting a pack into a pocket of the revolver.
Figure 1C:
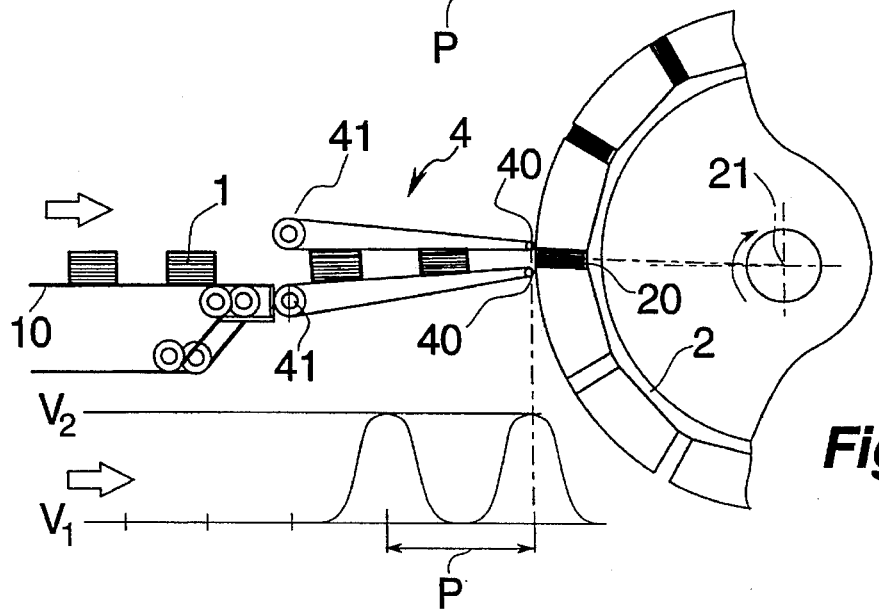
FIG. 1C shows the apparatus of FIG. 1A in its condition of completing the insertion of a pack into one pocket of the revolver.
Figure 2:
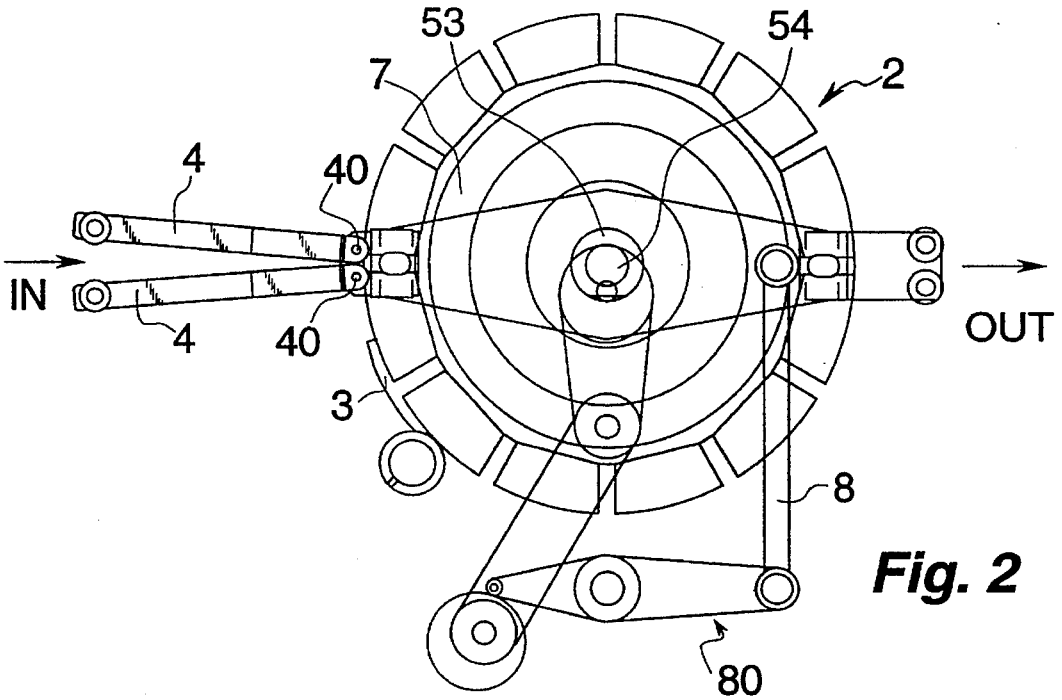
FIG. 2 is a schematic view in longitudinal section of the apparatus of FIG. 1A.
Figure 3:
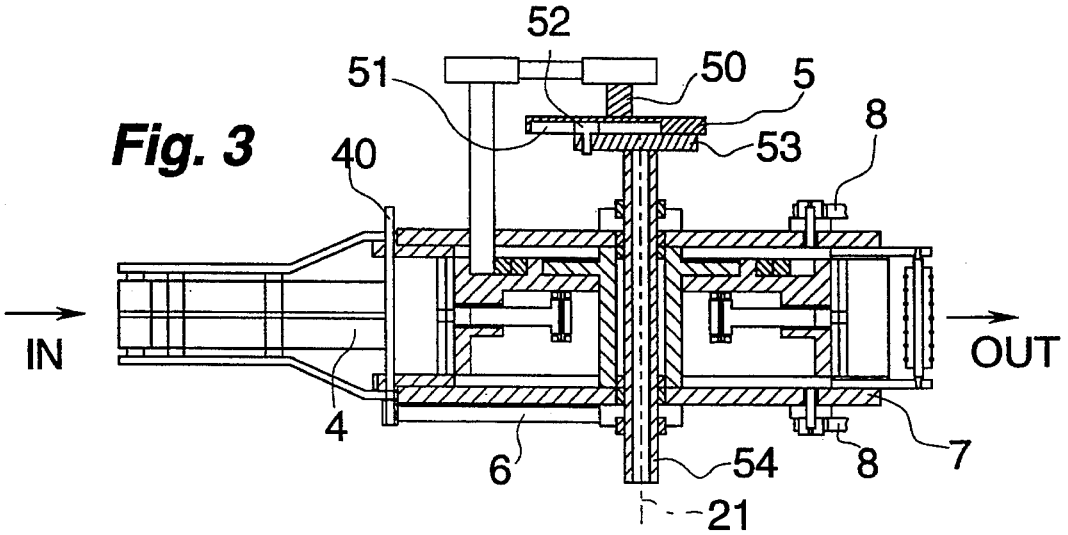
FIG. 3 shows a cross-section view of the apparatus of FIG. 2.

Reduced to its basic structure, and reference being made to FIGS. 1A–2 of the attached drawings, a method for continuously feeding packs of folded paper napkins to a wrapping machine, according to the invention, comprises in sequence the following operating steps:

progressively and continuously compressing, packs 1 to be wrapped, which are fed by a corresponding belt conveyer 10, and transferring them at the same time towards the revolver 2 of the machine by means of respective compressive and feeding members *4* at a speed cyclically varying between a minimum value V1 corresponding to the unloading speed of the machine making the packs, and a maximum value V2 at which they are inserted into the pockets 20 of the revolver 2;

inserting individually and in continuous succession each of the thus compressed packs 1 into a corresponding pocket 20 of the revolver 2.

In this way, each fully compressed pack 1 exhibits or contains a momentum, upon output from the compress/feed means 4, sufficient for allowing the insertion of the compressed pack 1 into the corresponding pocket 20. At the same time, momentum in also sufficient for the wrapping of the pack 1 within a polyethylene flap 3 which is kept adherent to the surface of the revolver 2 so that the polyethylene is interposed between the output path of the compress/feed means 4 and the pockets 20 into which the packs are actually inserted.

Advantageously, according to the invention, to allow for the complete and easy insertion of the packs 1 into the pockets 20 at a constant rotational speed of the revolver 2, provision is made for also driving the compress/feed means 4 into an alternative rotation. The rotation being about an axis disposed parallel to the axis 21 of rotation of the revolver 2 and the axis of rotation being in proximity of their input path. The alternative rotation being of angular amplitude approximately corresponding to the unloading time of a compressed pack 1 multiplied by the angular speed of the revolver 2. The rotation having a direction discordant to that of the revolver 2 upon the phase of insertion of the pack 1, and respectively concordant thereto upon the corresponding phase for the return to the initial operating condition.

Moreover, provision is made for advantageously varying the feeding speed of the means 4 with sinusoidal law having a period P approximately equal to half the feeding time of the packs 1, to allow for the gradual compression thereof.

It will be appreciated that, in order to make the compression of the packs 1 even more gradual, the speed variation may take place according to a sinusoidal law or function having a period P equal to any submultiple or whole fraction of the packs 1-feeding time.

As far as the apparatus for implementing the method is concerned, according to the invention and with reference to the figures of the attached drawings, it comprises:

compress/feeding means for progressively and substantially continuously compressing, the packs 1 to be wrapped which are fed by a belt conveyer 10 and, at the same time, transferring them towards the revolver 2 of a wrapping machine, by a pair of superimposed belt conveyers 4 converging towards the revolver 2 and operated by two driving superimposed rollers 40 parallel to the axis 21 of rotation of the revolver 2, the packs being interposed between the belt conveyers 4 individually and in continuous succession;

means for cyclically varying the feeding speed of the belt conveyers 4 between a minimum value V1 corresponding to the unloading speed of the machine making the packs 1, and a maximum value V2 at which the same packs 1 are inserted into the pockets 20 of the revolver 2, by means of a speed variator made up of a first wheel 5 fixed to the shaft 50 of a corresponding driving member and provided with a radial groove 51 to allow for the connection thereof, through a pin 52, with a second wheel 53 adjacent and parallel to the first one 5, so as to have the wheel 5 driving and the wheel 53 driven: the driven wheel 53 being in turn solid to a corresponding shaft 54 which is made to pass centrally idly through the body of the revolver 2 to be connected on the other side to the shaft of the lower driving roller 40 via a belt-type transmission 6;

alignment means for driving each of the belts 4 into an alternative rotation of predetermined angular amplitude about an axis 41 parallel to the axis 2 of rotation of the revolver 2, by means of a pair of arms 7 parallel and adjacent to the sides of the revolver 2. Each of these arms is centrally pivoted to shaft 8 and connected, on one side, to a crank mechanism 80 operated by the same driving shaft 50 of the speed variator. The arms 7 are pivoted on another end to the shafts of the rollers 40 provided for driving the belts 4.

Figure 4:
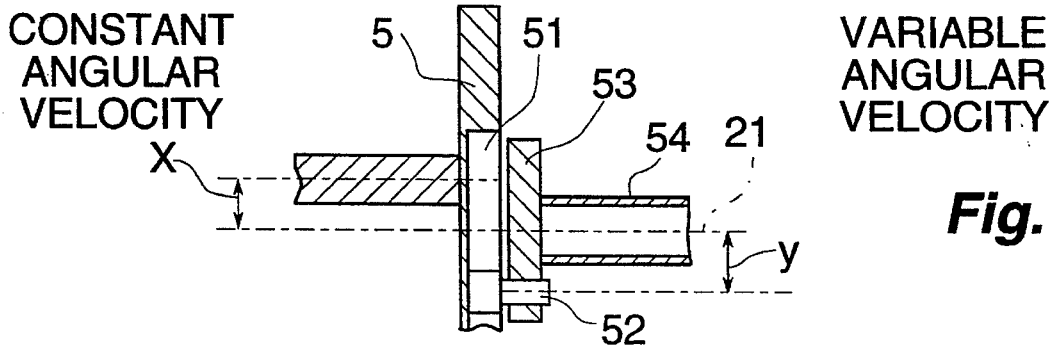
FIG. 4 shows a longitudinal section view of the speed variator of the apparatus of FIG. 2.

The operation of the above described speed variator, reference being made to FIGS. 4–5E of the attached drawings, is as follows.

The rotation of wheel 5 at constant angular velocity about the driving motor 50 is cause for the corresponding rotation of pin 52. And, as the pin 52 is free to translate along the axis of the groove 51, its distance from the shaft 50 is able to vary during the rotation, so that the wheel 53 rotates about the axis 21 of the shaft 54 at an angular speed cyclically varying with the angular phase of the wheel 5 according to a sinusoidal law. The amplitude and period P of the cyclic variation may be changed at will through a variation of the center distances (x, y between the wheels 5 and 53 and, respectively, between the pin 52 and the wheel 53.

Figure 6A:
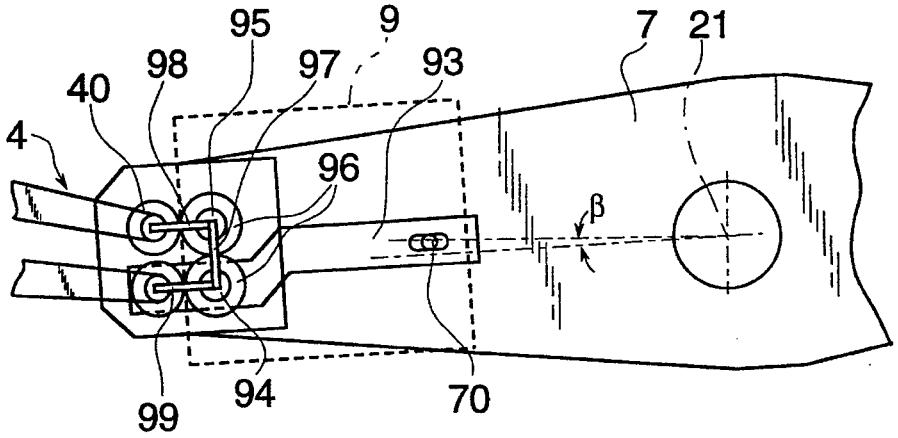
FIG. 6A shows schematically a variator for varying the angular phase of the rollers which drive the compressive belts, in a condition of initial compression of the packs to be wrapped.
Figure 6B:
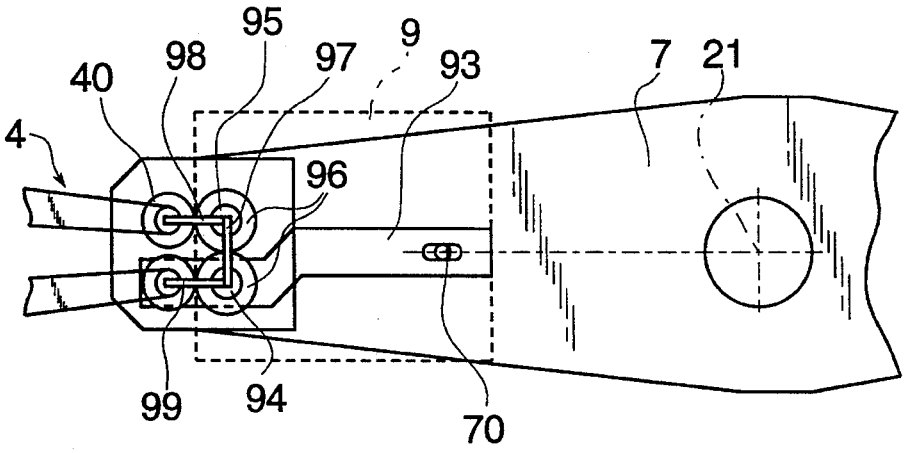
FIG. 6B shows the variator of FIG. 6A in a condition of initial insertion of a pack into a pocket of the revolver.
Figure 6C:
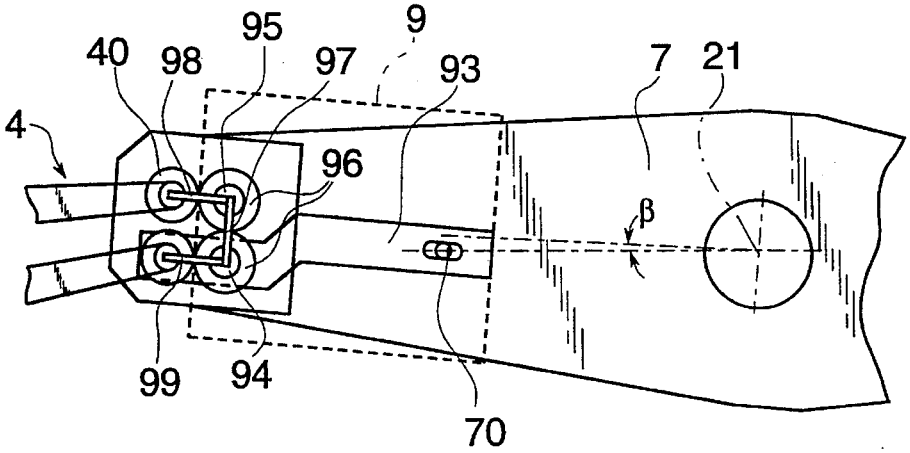
FIG. 6C shows the variator of FIG. 6A in a condition of completing the insertion of a pack into a pocket of the revolver.

Advantageously, according to the invention and with reference to FIGS. 6A–6C of the attached drawings, a cycle variator 9 is provided for varying the angular phase of the rollers 40 and enabling the longitudinal alignment of belts 4 to be resumed during the oscillation of arms 7.

More specifically, as the rotation of the arms 7 about the axis of the revolver 2 causes the angular phase shift of the rollers 40 and, consequently, the misalignment of the belts 4, with possible deformation of the packs 1 upon the compression and feeding thereof, provision is made for a variator or phase means 9 able to vary the angular phase of rollers 40, in relation to the angular position B of the arms 7, in order to achieve a constant longitudinal alignment of the belts 4 upon any instantaneous position thereof.

According to the invention, said variator 9 consists of:

a pair of adjacent toothed wheels 96 with equal horizontal parallel axes, and of a diameter greater than that of rollers 40, and whose hubs 94,95 are connected to each other by a toothed wheel rod 97, each of the wheels 96 engaging a gear of a corresponding roller 40 and being connected to the shaft thereof by a roller connecting rod 98, 99: the shaft of the upper wheel 96 being solid to the arm 7;

phase connecting rod 93 which, on one side, is idly mounted on a shaft 70 orthogonal to the arm 7 and placed at a position intermediate between the axis 21 of rotation of the revolver 2 and the wheels 96 and, on the other side, is hinged to the shaft of the lower roller 40: the rod 93 being provided with a shaft parallel to said shaft 70 to support the lower wheel 96.

The operation of the above described phase variator is as follows.

The rotation of the arm 7 about the axis 21 is cause for the discordant rotation of rod 93 about the shaft 70 and, accordingly, for the transmission of the rotational driving motion of belts 4 from the lower roller 40 to the upper roller 40 by means of the pair of wheels 96 and, at the same time, the correction of the angular phase of the upper roller 40, thereby allowing the belts 4 to be maintained longitudinally aligned and, therefore, the packs 1 vertically aligned upon their compression step.

Practically, all the construction details may vary n any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. A method for feeding compressible articles to a drum machine, the method comprising the steps of:

receiving the articles in succession at a first speed;

conveying the received articles by a conveyor belt to the drum machine;

compressing the received articles as the received articles are being conveyed to the drum machine;

varying a speed of said conveyor belt from said first speed to a second speed sufficient to eject each of the articles from said conveyor belt into a pocket of the drum machine;

inserting each article from said conveyor belt into the pocket of the drum machine.

2. A method in accordance with claim 1, wherein:

the articles are received in substantially continuous succession;

said conveying and compressing is simultaneously performed by passing the articles between two superimposed belts converging toward the drum machine;

said inserting is performed by varying a speed of said belts to cause the articles to be at said second speed when the articles leave said belts and be ejected into the pockets of the drum machine.

3. A method in accordance with claim 1, further comprising the steps of:

rotating the pockets of the drum machine;

passing the articles between first and second superimposed belts converging toward the drum machine to perform said conveying and compressing, said first and second belts having a first end receiving the articles, said first and second belts also having a second end positioned adjacent the drum machine and ejecting the articles;

pivoting said first and second belts about respective said first ends of said belts to cause respective second ends of said first and second belts to be adjacent the pockets during said inserting.

4. A method in accordance with claim 3, wherein:

said pivoting of said second ends of said first and second belts is a reciprocating motion having an amplitude substantially equal to an insertion time of one of the articles multiplied by a rotation speed of the pockets.

5. A method in accordance with claim 1, wherein:

said varying of said speed of said conveyor belt is substantially sinusoidal with a period substantially equal to half of a time for one of the articles to complete said compressing.

6. A method in accordance with claim 1, wherein:

said varying of said speed of said conveyor belt is substantially sinusoidal with a period substantially equal to a whole fraction of a time for one of the articles to complete said compressing.

7. An apparatus for feeding compressible articles to a drum machine, the apparatus comprising:

compress/feed means for receiving the articles in succession at a first speed and for conveying the received articles to the drum machine, said compress/feed means also compressing the received article as the received article is being conveyed to the drum machine;

speed means for varying a speed of conveying of said compress/feed means from said first speed to a second speed for ejecting each of the articles from said compress/feed means into a pocket of the drum machine.

8. An apparatus in accordance with claim 7, wherein:

said compress/feed means includes first and second superimposed belts positioned on substantially opposite sides of the articles and converging toward the drum machine to perform said conveying and compressing of the articles.

9. An apparatus in accordance with claim 8, wherein:

the pockets of the drum machine rotate about a drum machine axis;

said first and second belts are driven by rollers rotating about an axis substantially parallel to said drum machine axis.

10. An apparatus in accordance with claim 7, wherein:

said speed means includes a drive wheel, said drive wheel defining a radial groove, said speed means also including a driven wheel substantially parallel with said drive wheel, said driven wheel including a pin positioned slidable in said radial groove to be cyclically driven by said drive wheel, said driven wheel being connected to said compress/feed means.

11. An apparatus in accordance with claim 9, wherein:

said speed means includes a drive wheel, said drive wheel defining a radial groove, said speed means also including a driven wheel substantially parallel with said drive wheel, said driven wheel including a pin positioned slidable in said radial groove to be cyclically driven by said drive wheel, said driven wheel being connected to said rollers of said first and second belts.

12. An apparatus in accordance with claim 9, further comprising:

alignment means for pivoting said first and second belts about respective first ends of said belts to cause respective second ends of said first and second belts to be adjacent the pockets and aligning the articles ejected from said compress/feed means with the rotating pockets.

13. An apparatus in accordance with claim 12, wherein:

said alignment means includes a pair of arms adjacent the drum machine and pivotable about the drum machine axis, each of said arms is connected at a first end to a crank mechanism and at a second end to said second end of said first and second belts:

a same driving shaft drives said speed means and said crank mechanism.

14. An apparatus in accordance with claim 13, further comprising:

phase means for varying an angular phase of said of said rollers of said compress/feed means dependent on an angular position of said first belt.

15. An apparatus in accordance with claim 14, wherein:

said phase means includes a pair of adjacent toothed wheels with axes substantially parallel to said drum machine axis, said toothed wheels having a diameter greater than a diameter of said rollers, said toothed wheels having hubs connected to each other by a toothed wheel rod, each of said toothed wheels engaging a gear of a corresponding one of said rollers and being connected to said corresponding roller by a roller connecting rod, a shaft of said toothed wheel corresponding to said roller of said second belt being fixed to a corresponding arm, said phase means also including a phase connecting rod idly mounted on one of said arms and placed at a position between said drum machine axis and said toothed wheels, said phase connecting rod also being hinged to a shaft of said roller corresponding to said first belt, said phase connecting rod including a shaft substantially parallel to said drum machine axis to support said toothed wheel corresponding to said first belt.

* * * * *